United States Patent [19]

Lord et al.

[11] Patent Number: 4,915,047

[45] Date of Patent: Apr. 10, 1990

[54] KNOCK DOWN CATAMARAN WITH INFLATABLE PONTOONS

[75] Inventors: Christopher P. Lord, Bel Air; Tracy B. Collins, Towson, Md.

[73] Assignee: Kris-Jen Import Export Incorporated, Bel Air, Md.

[21] Appl. No.: 231,388

[22] Filed: Aug. 15, 1988

[51] Int. Cl.[4] ..... B63B 1/10

[52] U.S. Cl. ..... 114/39.1; 114/61; 114/123; 114/345

[58] Field of Search ..... 114/39.1, 61, 345, 123

[56] References Cited

U.S. PATENT DOCUMENTS

| | | | |
|---|---|---|---|
| 2,712,293 | 7/1955 | O'Higgins | 114/61 |
| 2,745,118 | 5/1956 | Potts et al. | 114/345 |
| 3,473,502 | 10/1969 | Wittkamp | 114/39 |
| 3,608,112 | 9/1971 | Irgens | 114/345 |
| 3,656,445 | 4/1972 | Padwick | 114/39 |
| 3,839,979 | 10/1974 | Wassel | 114/61 |
| 3,846,858 | 11/1974 | Syfritt | 114/345 |
| 3,902,443 | 9/1975 | McDougall | 114/39.1 |
| 3,930,274 | 1/1976 | Syfritt | 114/345 |
| 4,082,049 | 4/1978 | Nicol | 114/39 |
| 4,136,414 | 1/1979 | Popkin | 114/345 |
| 4,284,024 | 8/1981 | Montgomery | 114/61 |
| 4,348,971 | 9/1982 | Montgomery | 114/61 |
| 4,543,898 | 10/1985 | Castilla | 114/39 |
| 4,582,012 | 4/1986 | Montgomery | 114/61 |
| 4,653,417 | 3/1987 | White | 114/91 |
| 4,664,049 | 5/1987 | Mourgue et al. | 114/61 |
| 4,796,555 | 1/1989 | Chang | 114/39.1 |

FOREIGN PATENT DOCUMENTS

| | | | |
|---|---|---|---|
| 1508523 | 1/1968 | France | 114/352 |

*Primary Examiner*—Sherman D. Basinger
*Assistant Examiner*—Thomas J. Brahan
*Attorney, Agent, or Firm*—Leonard Bloom

[57] ABSTRACT

A catamaran boat, especially intended for knock-down disassembly and rapid assembly having a generally rectangular frame. The frame has longitudinal members which are releasably connected to transverse members. At least one of the transverse members is arched upwardly. A pair of pontoons having an upper and a lower section, individually inflatable, are disposed below the longitudinal frame members. The pontoons have a pair of sleeves, fore and aft, extending laterally through the pontoon. Pontoon locks are releasably connected to the transverse frame members and extend outwardly from the catamaran boat. One leg of the pontoon lock is disposed over the pontoon and a bight portion is arcuately connected to a second, substantially parallel, leg protion of the pontoon lock. The second leg portion passes through the sleeve in the pontoon and connects to the transverse frame member forming a loop. The catamaran boat is steered by a pair of rudders. Each rudder is also connected to a tiller and the tillers are interconnected by a transverse member. The catamaran has a mast releasably mounted to the forward arched transverse frame member and a boom and a sail are attached to the mast. The aft transverse frame member has a mount for a motor for an alternate means of propulsion. A tray with a well is connected to the frame. A battery for the motor is disposed in the well. Alternately, the well can be used for food, beverages and supplies. The catamaran boat further has oarlocks and a pair of oars.

39 Claims, 6 Drawing Sheets

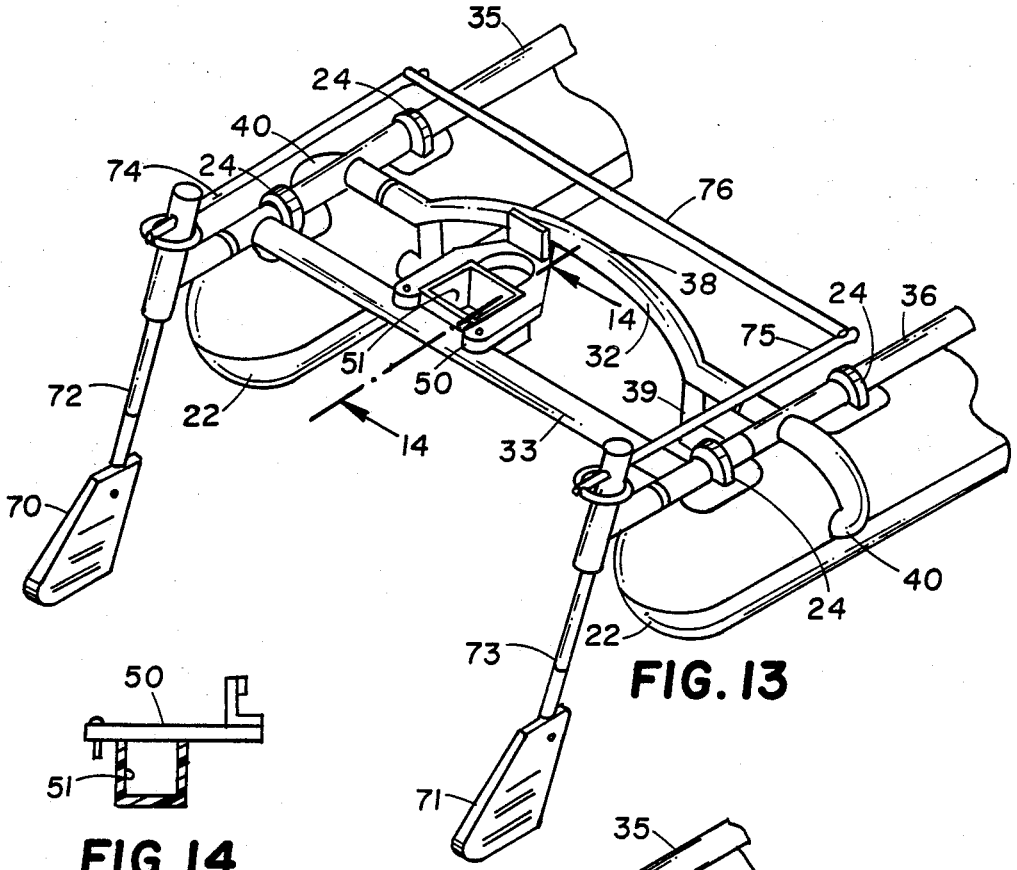
FIG. 13
FIG. 14
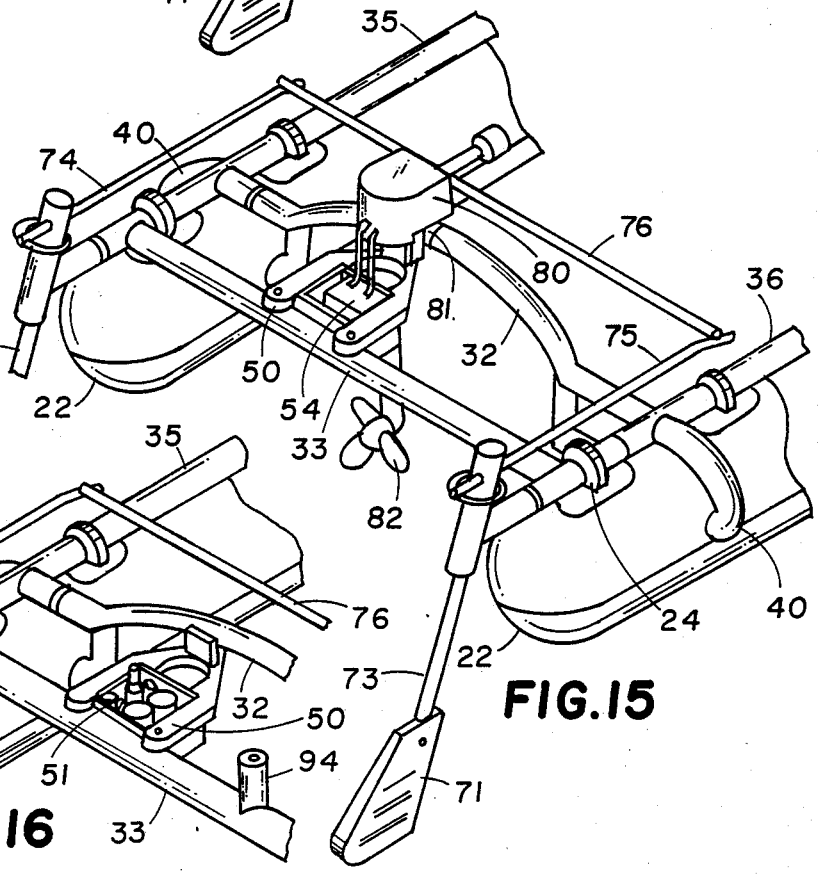
FIG. 15
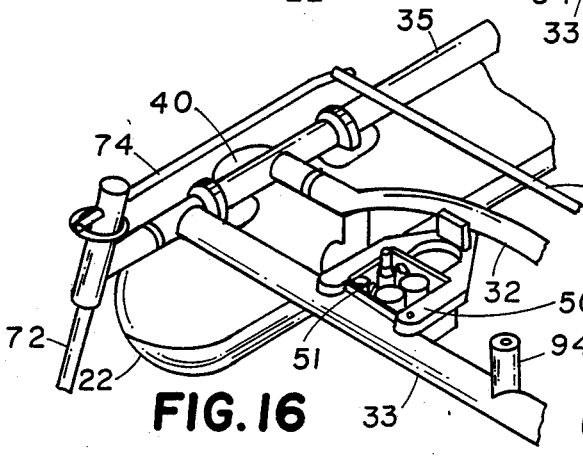
FIG. 16

KNOCK DOWN CATAMARAN WITH INFLATABLE PONTOONS

FIELD OF THE INVENTION

This invention relates to a catamaran boat with inflatable pontoons which is easily assembled and disassembled, is inexpensive, is relatively light in weight, is easily transportable when disassembled, and has the advantage of being powered by sail, motor or oars.

BACKGROUND OF THE INVENTION

Catamaran boats are well known in the prior art. These boats generally have high performance and stability. However, difficulties are encountered in transporting and storing the boat. This has led to designs for "knock-down" catamaran boats such as disclosed in U.S. Letters Pat. No. 2,712,293 issued to O'Higgins. Others have included inflatable pontoons in knock-down designs, as disclosed in U.S. Letters Pat. Nos. 4,316,414 issued to Popkin and U.S. Letters Pat. Nos. 4,284,024 and 4,348,971 issued to Montgomery. U.S. Letters Pat. Nos. 3,846,858 and 3,930,274 issued to Syfritt disclose a boat with a pair of units, each consisting of a plurality (preferably three) parallel, laterally spaced support members connected at each end and intermediately by transverse support members. These members define a triangular cage structure in which an inflatable container is supported. The following patents are further illustrative of the prior art:

| U.S. PAT. NO. | INVENTOR |
|---|---|
| 2,745,118 | Potts et al. |
| 3,473,502 | Wittkamp |
| 3,608,112 | Irgens |
| 3,656,445 | Padwick |
| 3,839,979 | Wassel |
| 4,082,049 | Nicol |
| 4,543,898 | Castilla |
| 4,582,012 | Montgomery |
| 4,653,417 | White |

The knock-down catamaran boats of the prior art have one or more of the following problems: (1) not sufficiently reliable or rugged; (2) complex and difficult to assemble; (3) the components are bulky, heavy and inconvenient to transport; (4) relatively expensive; (5) overly simplified and unappealing to the sophisticated sailor; and (6) principally directed towards a sailing vessel and have not included other means for propulsion.

Accordingly, there remains a need for an easily assembled "knock-down" catamaran boat which is relatively inexpensive, compact, rugged, and includes features normally found on more sophisticated and costly vessels.

SUMMARY OF INVENTION

A principal object of the present invention is to provide a catamaran boat with inflatable pontoons which is easily assembled and disassembled.

It is another object of the present invention to provide a knock-down catamaran boat which is rugged and has superior stability.

It is a further object of the present invention to provide a knock-down catamaran boat which is relatively inexpensive and, when disassembled, is compact, relatively light in weight, and easily transportable.

It is still another object of the present invention to provide a knock-down catamaran boat which includes features found on sophisticated vessels which appeal to the experienced and discerning sailor.

In accordance with the teachings of the present invention, there is herein disclosed a catamaran boat, especially intended for knock-down disassembly and relatively rapid assembly, wherein the boat includes a generally rectangular frame having spaced apart longitudinal frame members. A pair of inflatable pontoons is disposed below the longitudinal frame members, respectively, and has respective side portions; and a pair of spaced-apart supporting pontoon locks are provided for each pontoon, the pontoon locks being arranged fore and aft of the boat. The rectangular frame further includes a pair of spaced-apart yoke members disposed substantially transversely of the longitudinal frame members and arranged fore and aft of the boat, respectively; and means are provided for releasably connecting each yoke member to the longitudinal frame members, respectively.

In a preferred embodiment, the pontoon lock is a substantially "U" shaped member arranged transversely with respect to the pontoon. The "U" shaped pontoon lock has an upper leg portion, a substantially parallel lower leg portion and an intermediate bight portion connecting the leg portions. The bight portion is substantially arcuate and is convex when viewed externally of the boat. The upper leg portion and bight portion are disposed external to the pontoon and the lower leg portion constitutes the member which passes transversely through the pontoon. The leg portions are releasably connected to the yoke members of the rectangular frame, thereby forming a loop which connects the pontoon with the frame. The releasable connection preferably is a "double D" design to reduce rotational movement of the connection. However, other connections such as pins threaded members, a twist and lock, or a bayonet type fitting could be used.

It is further preferred that the inflatable pontoon has a pair of sleeves, fore and aft, extending laterally through the pontoon through which the lower leg portion of the pontoon lock is slideably inserted.

Preferably, the pontoon includes an upper section and a lower section separated by a horizontal wall. Each section has a valve for independent inflation. The upper surface of the pontoon has a plurality of aligned eyelets bonded thereto, and when assembled, the longitudinal frame member is guided through the eyelets to support the pontoon and provide strength and stability. Further, a rigid fin is removably mounted on the bottom surface of each pontoon to provide additional stability to the catamaran.

Preferably, the removable mounting of the fin comprises the pontoon having a pair of spaced apart clips, a first clip and a second clip, attached to the bottom surface of the pontoon. The first clip has at least one protrusion extending therefrom in the direction of the second clip. The second clip has a retractable latch extending therefrom in the direction of the first clip. The fin has a forward edge, an aft edge and a top edge. The aft edge of the fin, adjacent to the top edge has at least one opening therein wherein there may be inserted the protrusion of the first clip. The forward edge of the fin adjacent to the top edge has an opening therein wherein there may be inserted the retractable latch extending from the second clip. When the protrusion of the first clip is inserted into the opening on the aft edge of the fin, the top edge of the fin is disposed adjacent to the bottom surface of the pontoon. The retractable latch on the second clip is inserted into the opening in the forward edge of the fin. In this manner, the fin is securely and removably retained on the bottom surface of the pontoon.

The retractable latch extending from the second clip attached to the bottom surface of the pontoon includes the clip having a forward end and an aft end and an opening extending therebetween. A latch is slideably inserted in the opening wherein the latch may be extended from the opening. A living hinge has a first and a second end, the first end is attached to the latch and the second end is integrally molded to the clip. When the latch is manually inserted in the forward end of the opening in the clip, it may be slideably mounted through said opening and extended from the aft end of said opening to be inserted into the opening in the fin. This mounts the fin to the pontoon. When the hinge is manually extended forwardly, the latch is retracted into the opening in the clip and the fin may be dismounted from the pontoon.

In the preferred embodiment, the yoke member has an intermediate portion (disposed between the longitudinal frame members) which is bent upwardly to form an arch. The fore yoke member has a fitting at the apex of the arch for mounting the mast. Further, each longitudinal frame member has an end extending upwardly and forwardly therefrom. A forward cross bar member extends transversely between, and is releasably connected to the forwardly and upwardly extending ends of the longitudinal frame members, so that the forward cross bar member is substantially parallel to the fore yoke member. A pair of stays are connected to the forwardly and upwardly extending ends of each longitudinal frame member, and the stays extend upwardly to a stay ring mounted near the top of the mast. A boom is connected to the mast, and a sail is mounted on the boom and mast.

The catamaran boat further has a pair of rudders releasably connected to the aft ends, respectively, of the longitudinal frame members. Each rudder is further connected to a tiller; and the tillers are releasably connected to a transverse member therebetween, whereby movement of the transverse member, or of a tiller, is simultaneously transmitted to both rudders.

Preferably, the aft yoke member has a mount for a motor with a downwardly extending propeller as an alternate means for propulsion of the catamaran. The aft yoke member of the frame has an intermediate portion disposed between the longitudinal frame members, the intermediate portion being bent upwardly to form an arch. The motor mount is at the apex of the arch. Further, an aft cross bar member extends transversely between the respective aft ends of the longitudinal frame members and is releasably connected thereto. A rack connects the aft cross bar member and the aft yoke member. The rack has a well with a bottom and at least four sides, and the battery for the motor is disposed in the well. Alternately, the well can be used as a storage receptacle for food, drinks and supplies.

To facilitate a third mode of propulsion, the catamaran has oarlocks mounted on each longitudinal frame member, and a pair of oars is fitted thereto for manual propulsion of the catamaran.

Viewed in another aspect, the present invention provides a knock-down catamaran boat that is rugged and reliable and may be readily assembled and disassembled. The boat comprises a plurality of molded-plastic tubular frame members adapted to be fitted together, and a pair of spaced-apart inflatable pontoons removably supported by the frame members and depending therefrom. The pontoons may be readily inflated during assembly of the boat and may be readily deflated during disassembly of the boat. The frame members have respective portions nested within each other and frictionally held together, such that the frame members are removably secured together without the necessity for loose hardware. Also at least some of the respective nested portions of the frame members are keyed together to preclude relative rotation therebetween.

Preferably, each pontoon has a substantially circular cross-section having a diametral axis. The frame members include respective pontoon locks arranged fore and aft on each pontoon. Each pontoon lock comprises a substantially "closed loop" pontoon-supporting structure which includes a portion thereof passing substantially horizontally through the pontoon and substantially adjacent to the diametral axis thereof.

In accordance with the further teachings of the present invention, a kit is provided which contains the components of the catamaran, including the frame members, the pontoons, pontoon locks, means for propulsion, rudders and tiller, the mast, the boom, the rack, the deck, and hardware and fittings for assembly.

The catamaran boat described herein provides an easily assembled and disassembled boat which can be used for many recreational purposes including fishing, sailing, etc. It provides many features attractive to the sophisticated sailor. When assembled, the boat would have approximate dimensions of a height of 12 ft., a beam of 6½ ft., a length of 10 ft. and a weight of 60 lbs. In its disassembled condition, the boat can be stored in a station wagon or in the trunk of an automobile.

These and other objects and advantages of the present invention will become apparent from a reading of the following specification taken in conjunction with the enclosed drawings.

BRIEF DESCRIPTION OF THE DRAWINGS

FIG. 13 is a partial perspective view of the steering means including the rudder, tiller, and aft cross bar.

FIG. 14 is a cross sectional view, taken along the lines 14—14 of FIG. 13, and showing the motor mount, the rack and the well.

FIG. 15 corresponds to FIG. 13, but shows the battery mounted in the well, and further shows the motor mounted on the motor mount.

FIG. 16 corresponds to a portion of FIG. 15, but shows an alternate use of the well.

DESCRIPTION OF THE PREFERRED EMBODIMENTS

Figure 1:
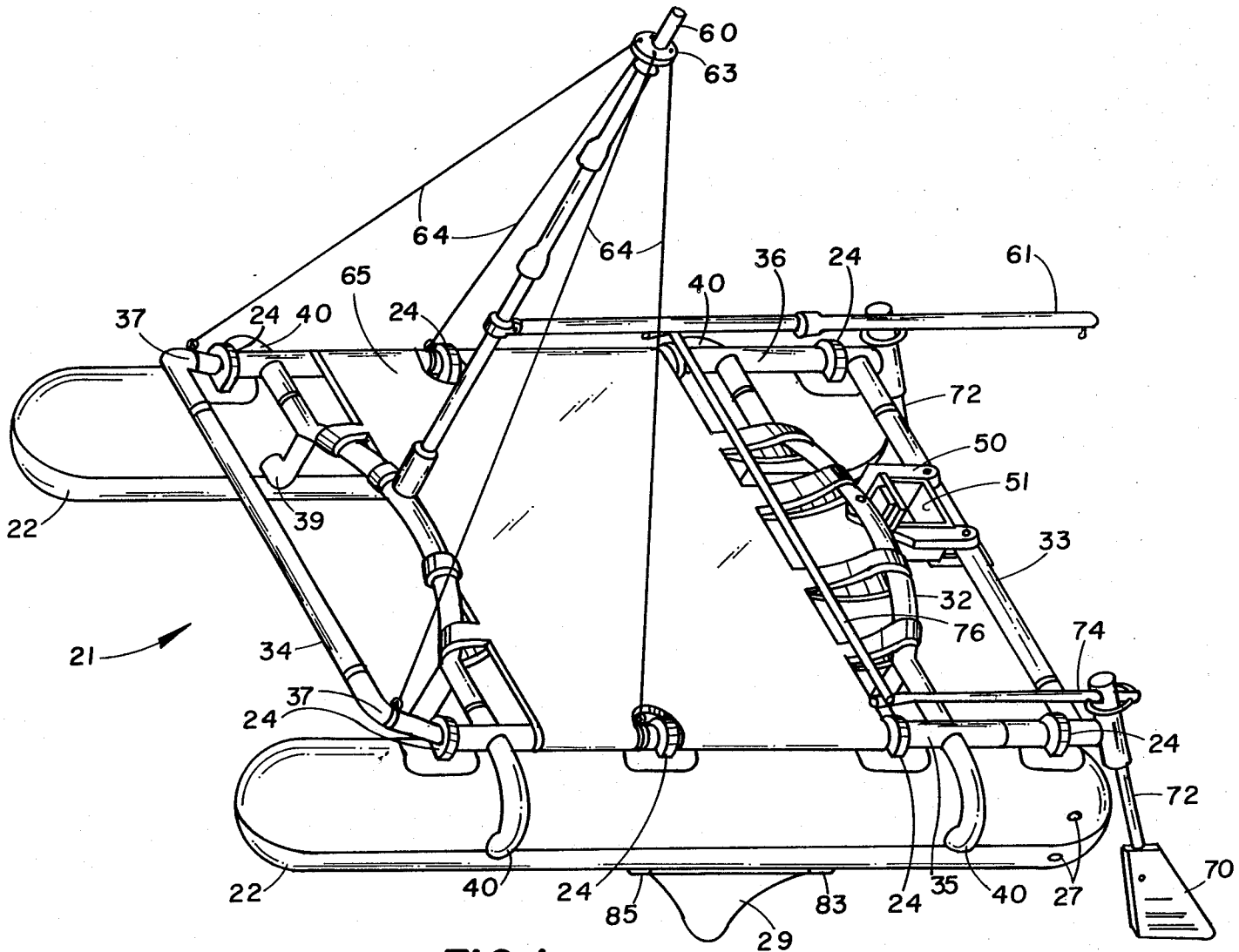
FIG. 1 is a perspective view of the catamaran boat with the sail omitted for ease of illustration.
Figure 2:
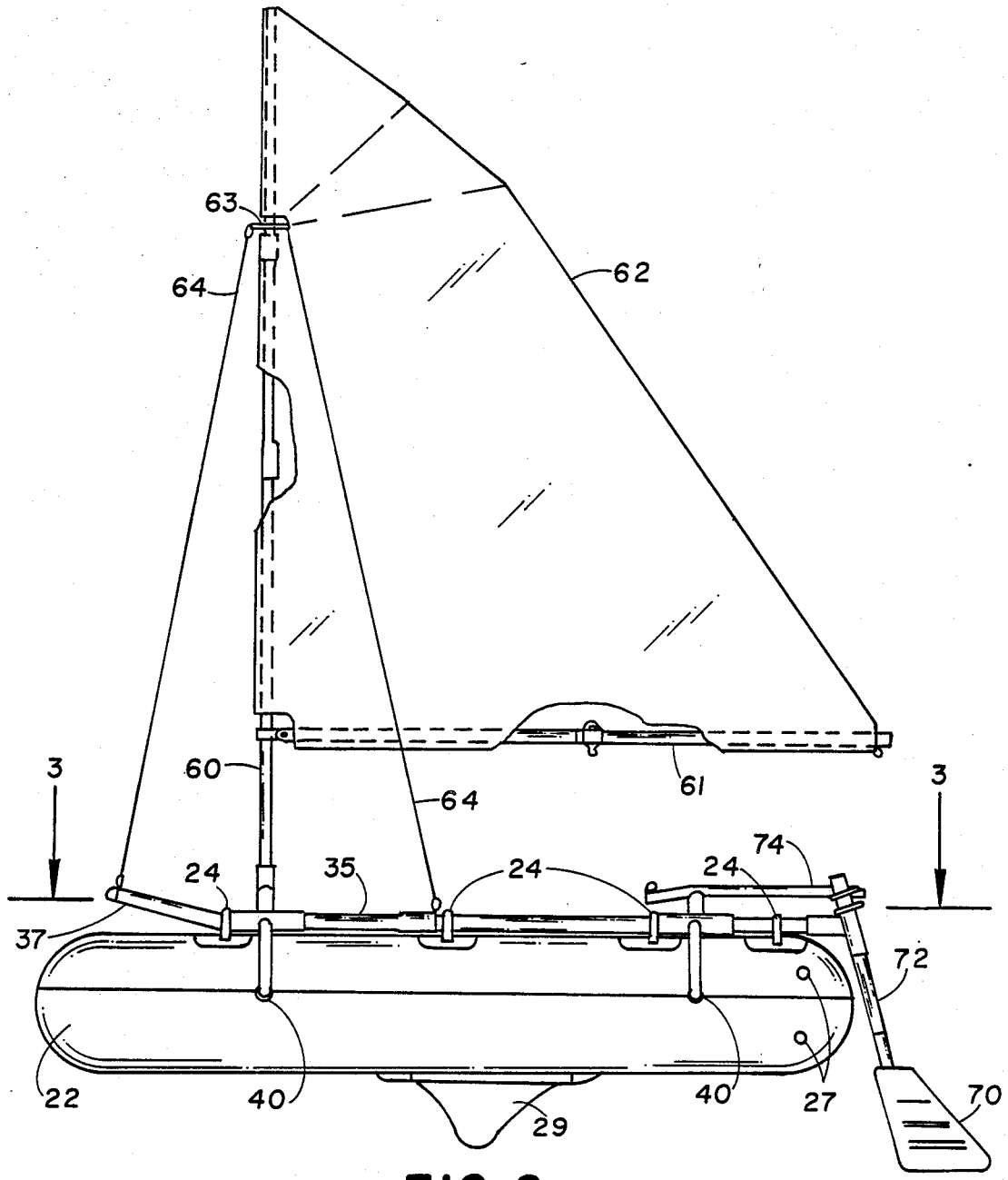
FIG. 2 is a side elevation view of the catamaran boat.

Referring to the drawings, and as shown in FIGS. 1 and 2, the catamaran boat 21 has two pontoons 22 of which are disposed below a rectangular frame 30. The boat further has a mast 60, a sail 62, rudders 70, 71, tillers 74, 75 and a deck 65.

Figure 3:
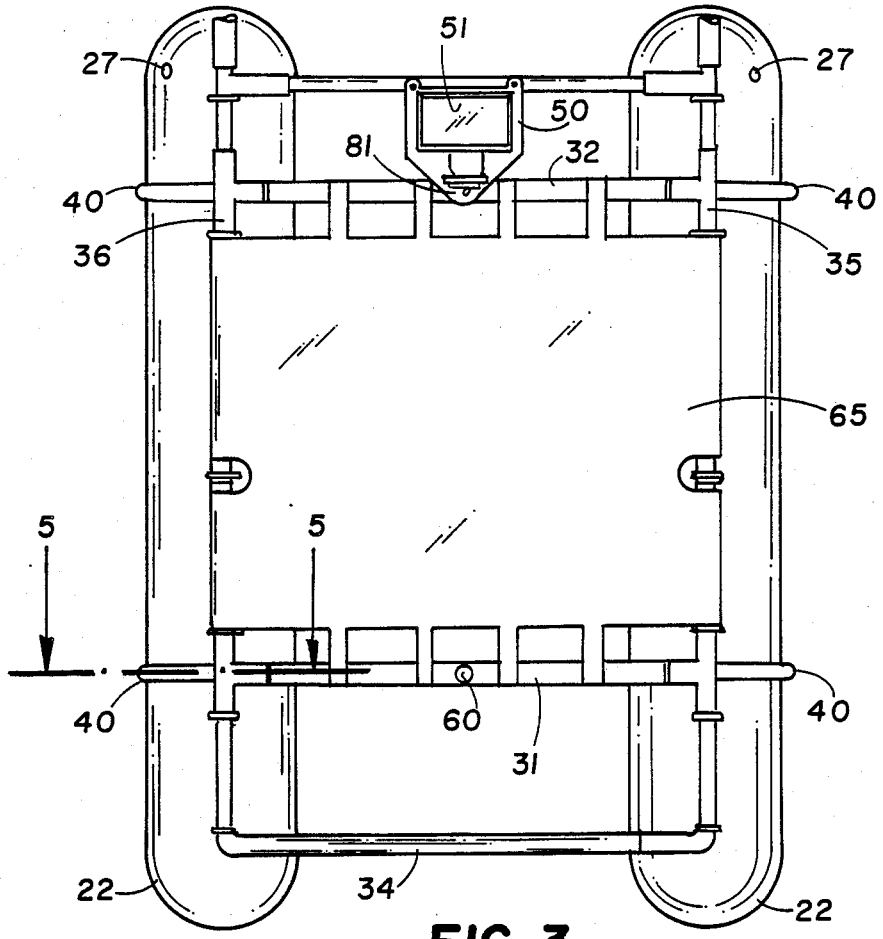
FIG. 3 is a horizontal cross section on the line 3—3 of FIG. 2.
Figure 4:
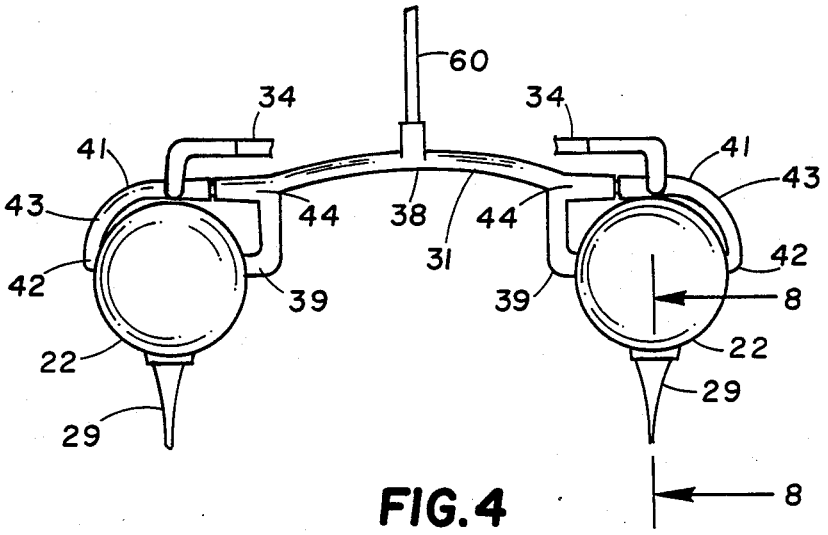
FIG. 4 is a partial front end view of the catamaran boat (the forward cross-bar member being partially broken away for clarity of illustration).
Figure 8:
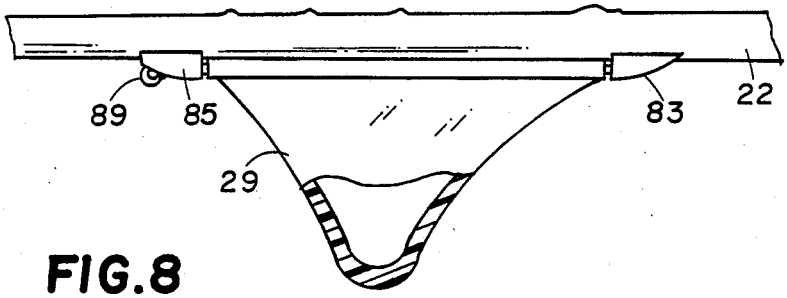
FIG. 8 is an enlarged view taken on the lines 8—8 of FIG. 4, partially in section and partially in elevation, and showing the fin mounted on the bottom surface of the pontoon.
Figure 9:
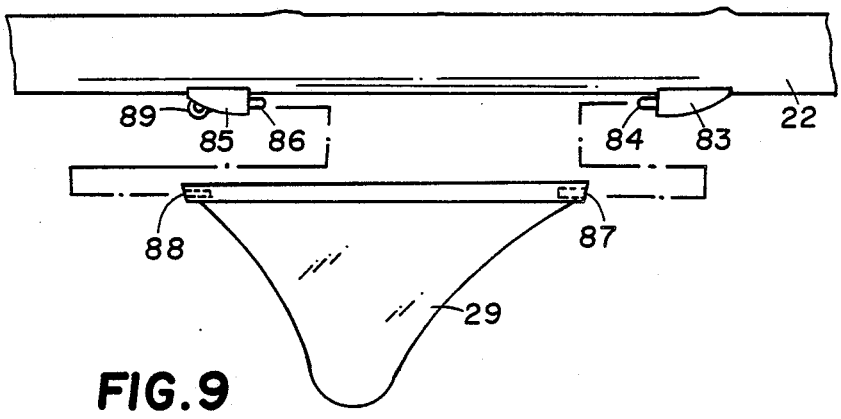
FIG. 9 is an exploded elevational view, showing the means for removably mounting the fin on a clip attached to the bottom surface of the pontoon.
Figure 10:
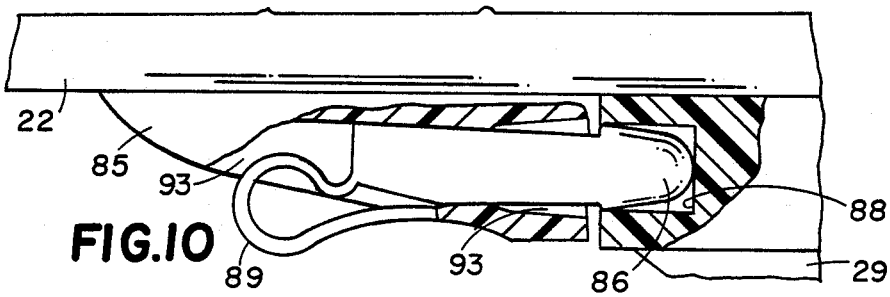
FIG. 10 is an enlarged longitudinal section of the clip of FIG. 9, showing the retractable latch in an extended position, and inserted into the fin.
Figure 11:
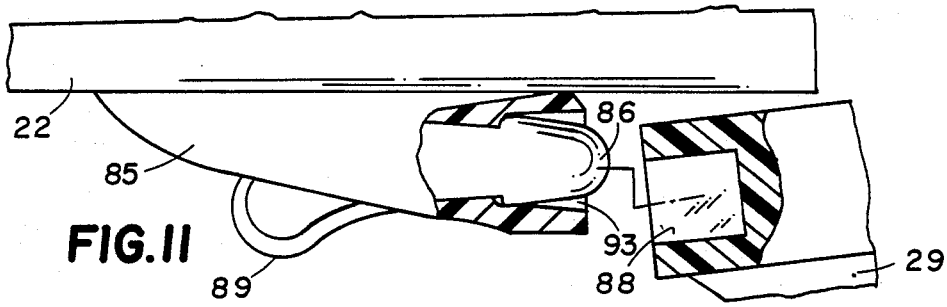
FIG. 11 is an enlarged longitudinal section of the clip of FIG. 9, showing the retractable latch in an extended position, and inserted into the fin.

The pontoon 22 is a cylindrical tube with rounded ends which has sleeves 23 extending laterally through the pontoon 22, fore and aft (FIGS. 1–6). A portion of the pontoon lock 40 passes through these sleeves as shall be detailed later. In addition, the pontoon, on its upper surface, has a plurality of aligned eyelets 24 bonded thereto. The longitudinal frame members 35, 36 are guided through these eyelets and, in addition to connecting the pontoon 22 to the frame 30, provide structural support to the pontoon 22. The lower surface of each pontoon is formed with tabs to which a fin 29 is attached (FIGS. 4 and 8). The fin provides additional lateral stability to the catamaran boat. Also, since the fin 29 is hollow, it fills with water and adds to the weight of the boat 21 to provide overall stability.

The removable mounting of the fin 29 comprises a pair of clips 83, 85 attached to the bottom surface 26 of the pontoon. The first clip 83 has at least one protrusion 84 extending in the direction of the second clip 85 and the second clip has a retractable latch 86 extending in the direction of the first clip 85. The fin 29 has openings on the forward edge 88 and the aft edge 87. The protrusion 84 on the first clip 83 is inserted into the opening on the aft edge 87 of the fin 29 and the top edge of the fin is disposed adjacent to the bottom surface 26 of the pontoon. The second clip 85 has an opening 93 extending between the forward end to the aft end. The retractable latch 86 is manually inserted from the forward end of the clip 85 into the opening 93 and slideably guided until it extends from the aft end of the clip 85. The latch 86 is inserted into the opening 88 in the forward edge of the fin 29, thereby mounting the fin 29 to the bottom surface 26 of the pontoon 22. In order to dismount the fin 29, the hinge 89, which is attached to the latch 86 and the second clip 85, is manually extended forwardly. The latch 86 is withdrawn from the opening 88 in the fin 29 and retracted into the opening 93. It will be appreciated by persons skilled in the art, that the clip with the retractable latch may be attached to the pontoon so as to accommodate the opening in the aft edge of the fin and the protrusion of the first clip may be inserted into the opening in the forward edge of the fin.

It is preferred that the pontoon 22 be inflatable for ease of transportability and construction from a rugged, waterproof, air impermeable material such as vinyl has been employed satisfactorily. The pontoon 22 has a separate upper section 25 and a lower section 26 separated by a horizontal wall 28 to provide greater safety in the event that the pontoon is punctured or the water integrity is, in anyway, disrupted. In such an event, one section of the pontoon 22 would remain inflated and the catamaran boat 21 would be able to remain afloat. Additionally, each section has an independent valve 27 for inflation of the respective section up to approximately 15 psi. The upper surface of the horizontal wall 28 of the pontoon 22 has a sleeve 23 attached which corresponds to the opening through which the pontoon lock 40 passes. This sleeve 23 is fabricated of the same material as the wall 28 and extends completely across the pontoon 22.

The frame 30 is generally rectangular with longitudinal frame members 35, 36 and transversely thereto, a fore yoke member 31 and an aft yoke member 32 (FIG. 3). Preferably, these members are releasably connected. The frame is preferably constructed of material such as polyvinyl chloride (PVC) tubing which is unaffected by salt or fresh water, relatively light in weight and comparatively inexpensive. In addition to the transverse yoke members 31, 32, there are additional transverse members, a forward cross bar member 34 and an aft cross bar member 33 (as shall be discussed later).

Figures 5, 6, 7:
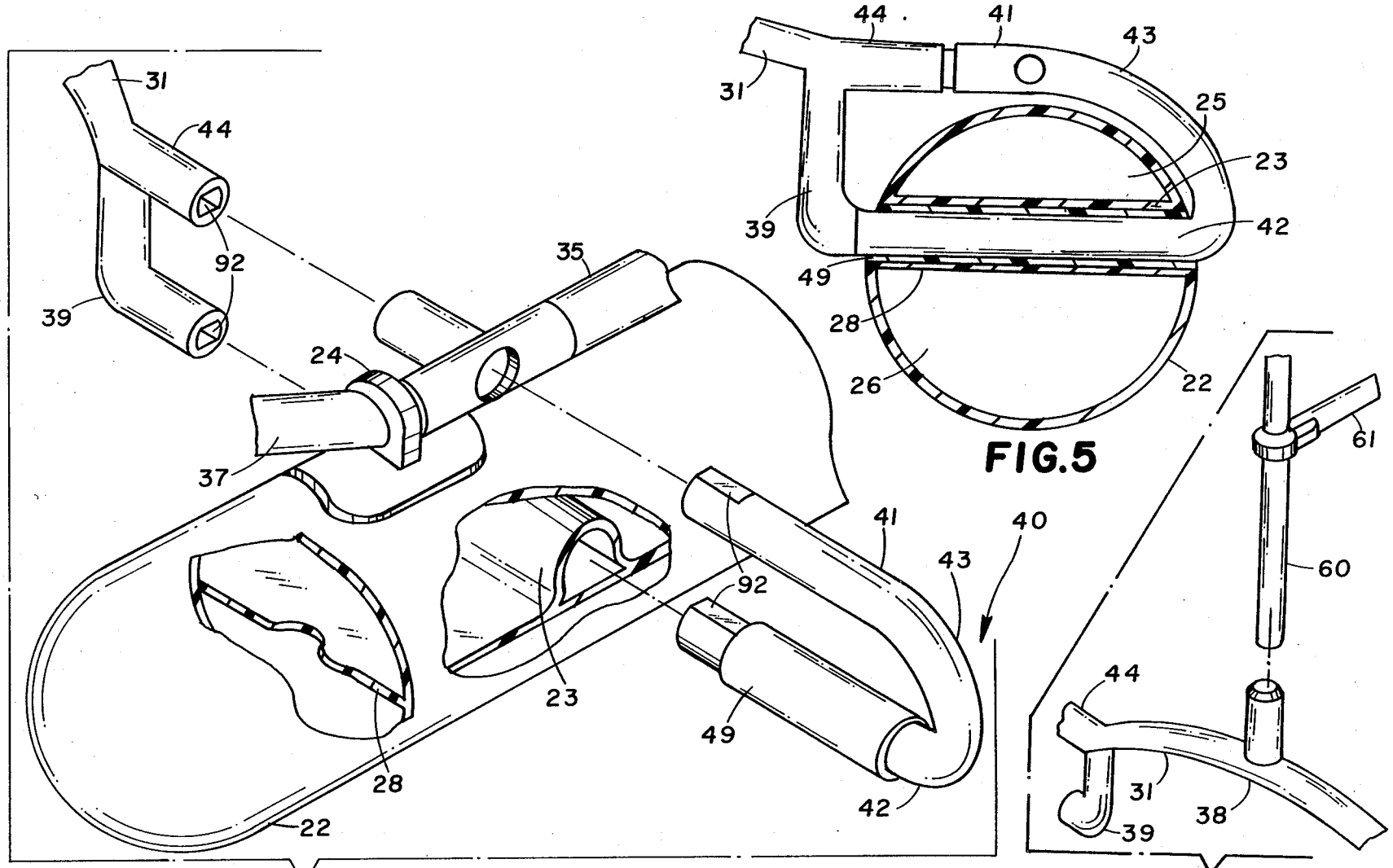
FIG. 5 is a vertical cross section on the line 5—5 of FIG. 3 showing the pontoon, sleeve in pontoon and pontoon lock.
FIG. 6 is a partial exploded perspective view showing the pontoon, pontoon lock and forward yoke member.
FIG. 7 is a partial exploded perspective view showing the forward yoke member, mast, boom and sail.

The fore yoke member 31 extends between the longitudinal frame members 35, 36 bending upwardly in an arch 38 (FIGS. 1, 4 and 7). This structure serves as a truss and provides additional strength to the frame to more evenly distribute weight and stress caused by persons on the deck 65 or by uneven water movement against the pontoons 22. The mast 60 is mounted at the apex of the arch 38 on the fore yoke member 31 and the arch 38 structure provides additional structural support to the mast 60. Near each outer end of the fore yoke member 31 and the aft yoke member 32, there is a downward extending "L" shaped structure 39 (FIGS. 4–7. The pontoon lock 40 is connected to these portions of the yoke members 31, 32. The pontoon lock 40 is a "U" shaped member arranged transversely with respect to the pontoon 22 (FIGS. 4–6). The pontoon lock 40 has an upper leg portion 41 and a substantially parallel lower leg portion 42. The leg portions 41, 42 are connected by an intermediate bight portion 43 which is substantially arcuate and is convex when viewed externally of the boat 21. The upper leg portion 41 is disposed above the pontoon 22 and the lower leg portion 42 is inserted into a rigid cylinder 49 both of which extend through the sleeve 23 in the pontoon 22. The inboard portions of the upper leg 41 and lower leg 42 are connected, preferably in a releasable manner, with the yoke members 31, 32; the upper leg 41 communicating with the upper segment 44 of the yoke members 31, 32 and the lower leg 42 communicating with the "L" shaped portion 39 of the yoke members 31, 32. The pontoon lock 40 connection with the yoke member 31, 32 forms a structural loop fore and aft on each pontoon 22. This loop provides a positive attachment between the frame 30 and the pontoon 22, but more importantly, increases the sailing stability of the boat 21. It accomplishes this by reducing stress on the pontoon 22 and the frame 30 and by acting as an extension of the arch 38 in the yokes 31, 32 to effectively distribute the weight over an even greater area.

The ends 37 of the longitudinal frame members 35, 36 extend forwardly and upwardly of the fore yoke member 31. The ends 37 of the longitudinal frame members 35, 36 are releasably connected to the fore cross bar member 34 which extends transversely between the forward portions 37 of the longitudinal frame members 35, 36 substantially parallel to the fore yoke member 31 and projecting forwardly of the mast 60 (FIGS. 1-2). This feature of the frame 30 provides additional sailing stability to the catamaran boat 21 by providing for improved weight distribution. The fore cross bar member 34 also serves as a hand grip for transport of the assembled boat 21 and greatly assists in removal of the boat 21 from the water. In addition, the upward extension prevents wear of the forward ends of the pontoons. Under sailing conditions, the tips of the pontoons flex upwardly and would abrade against the frame members without this design feature.

Attached to the forwardly and upwardly extending ends 37 of the longitudinal frame members 35, 36 are stays 64 which extend upwardly to a stay ring 63 mounted near the top of the mast 60. Additional stays 64 also extend between the stay ring 63 and the mid portion of the longitudinal frame members 35, 36 to securely hold the mast 60 in its upright position. Preferably, the mast 60 comprises releasably connected sections for ease of assembly, disassembly and transportation. A boom 61 and a sail 62 are attached to the mast 60.

The catamaran boat 21 is steered by a pair of rudders 70, 71 which are constructed of a rigid material such as polypropylene (FIGS. 2 and 13). Each rudder is releasably connected to a rudder arm 72, 73 which is, in turn, connected to the aft end of the respective longitudinal frame members 35, 36. The rudder arms 72, 73 extend upwardly above the longitudinal frame members 35, 36 and are connected to tillers 74, 75. The tillers 74, 75 are further pivotally interconnected transversely by a bar 76 so that movement of either tiller 74, 75, or bar 76, is translated to both rudders 70, 71, simultaneously.

An aft ends of the longitudinal frame members 35, 36 are releasably connected to a transverse aft cross bar member 33 which provides additional strength to the frame (FIGS. 3, 13 and 15).

An alternate means for propulsion of the catamaran boat 21 is by a motor 80 which is attached to a motor mount 81 positioned on the aft yoke member 32 with the motor propeller 82 extending downwardly (FIGS. 3 and 15). The motor mount 81 is at the apex of the arch 38 of the aft yoke member 32 to distribute the weight to the frame 30. It is preferred that an electric motor be employed as the propulsion means to conserve weight and eliminate the need to have liquid fuel aboard. In order to provide for a battery 54 for energizing the motor 80, a rack 50 having a well 51 therein is connected between the aft yoke member 32 and the aft cross bar member 33 (FIGS. 3, 13 and 14). The operator of the catamaran boat 21 has the option of selecting sail 62 and/or motor 80 propulsion. In the event that a motor is not used, the well 51 may be used for storage of food, drink and/or supplies (FIG. 16).

Figure 12:
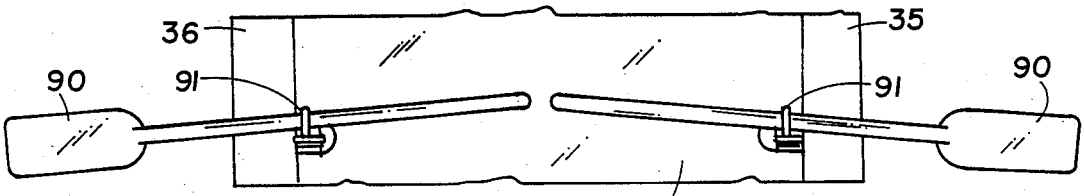
FIG. 12 is a top plan view showing the oars and oarlocks.

Another alternate means of propulsion for the catamaran boat 21, is by manually operated oars 90, (FIG. 12). Attached to the longitudinal frame members 35, 36 are oarlocks 91 into which the oars 90 can be fitted. This provides the operator of the catamaran boat 21 with another means of propulsion which can be employed independently or conjunctively with the sail 62 and/or motor 80.

The catamaran boat further has a deck 65 connected to the frame 30 (FIG. 3). Preferably, it is a trampoline design with front edges, back edges and side edges. The side edges are slideably fitted over the longitudinal frame members 35, 36 and the front and back edges have loops which are secured to the fore and aft yoke members 31, 22.

For additional recreational use, a fishing rod holder 94, is attached to the aft cross bar member 33.

A "double D" connection 92 is preferred for the pontoon lock to reduction rotational movement of the connection (FIG. 6), however, other releasable connections such as pins, threaded members, twist and lock or a bayonet type fitting can be used for ease of assembly/-disassembly.

The components of the catamaran boat 21 are provided in a kit which includes simple instructions for assembly/disassembly.

What is claimed is:

1. In a catamaran boat, especially intended for knock-down disassembly and relatively rapid assembly, the combination which comprises a generally rectangular frame including a pair of spaced-apart longitudinal frame members, the frame further including a pair of spaced-apart yoke members disposed substantially transversely of the longitudinal frame members and fore and aft of the boat, respectively, means for releasably connecting each yoke member to the longitudinal frame members, respectively, a pair of inflatable pontoons disposed below the longitudinal frame members, respectively, and having respective side portions, a pair of spaced-apart supporting pontoon locks for each pontoon, arranged fore and aft of the boat, respectively, wherein the pontoon lock is substantially "U" shaped and arranged transversely with respect to the pontoon, the pontoon lock including a pair of leg portions which are substantially parallel, an upper leg portion and a lower leg portion;

the leg portions connected by an intermediate bight portion, the upper leg portion and the bight portion external to the pontoon, the lower leg portion passing transversely through the pontoon, and means for releasably connecting the pontoon lock to the yoke member such that a pair of supporting structural loops is provided for each pontoon and fore and aft thereof.

2. The catamaran boat of claim 1, wherein the bight portion of the "U" shaped member is substantially arcuate and is convex when viewed externally of the boat.

3. The catamaran boat of claim 1, wherein the upper and lower leg portions of the pontoon lock are releasably connected with the fore and aft yoke members respectively.

4. The catamaran boat of claim 3, wherein at least one of the leg portions of the pontoon lock is nested with the yoke member and wherein a pin member is inserted transversely through the nested leg portion and yoke member respectively.

5. The catamaran boat of claim 1, wherein the inflatable pontoon has a pair of sleeves, fore and aft, extending laterally through the pontoon, whereby the respective lower leg portions can pass transversely therethrough.

6. The catamaran boat of claim 1, wherein each pontoon has a bottom surface and wherein a fin is removably mounted on the bottom surface of the pontoon.

7. The catamaran boat of claim 6, wherein the removable mounting of the fin comprises:

the pontoon having a pair of spaced apart clips, a first clip and a second clip, attached to the bottom surface of the pontoon, the first clip having at least one protrusion extending therefrom in the direction of the second clip, the second clip having a retractable latch extending therefrom in the direction of the first clip, the fin having a forward edge, an aft edge and a top edge, the aft edge of the fin , adjacent to the top edge having at least one opening therein wherein there may be inserted protrusion of the first clip, the forward edge of the fin adjacent to the top edge having an opening therein wherein there may be inserted the retractable latch extending from the second clip, whereby when the protrusion of the first clip is inserted into the opening on the aft edge of the fin, the top edge of fin is disposed adjacent to the bottom surface of the pontoon and the retractable latch on the second clip is inserted into the opening in the forward edge of the fin, the fin is securely and removably retained on the bottom surface of the pontoon.

8. The catamaran boat of claim 7, wherein the retractable latch extending from the second clip attached to the bottom surface of the pontoon comprises:

the clip having a forward end and an aft end and an opening extending therebeween, a latch slideably inserted in the opening wherein the latch may be extended from the opening, a living hinge having a first and a second end, the first end attached to the latch and the second end integrally molded to the clip, wherein when the latch is manually inserted in the forward end of the opening in the clip, it may be slideably guided through said opening and extended from the aft end of said opening to be inserted into the opening in the fin, thereby mounting the fin to the pontoon, and when the hinge is manually extended forwardly, the latch is retracted into the opening in the clip and the fin may be dismounted from the pontoon.

9. The catamaran boat of claim 1, wherein the inflatable pontoon comprises an upper section, a lower section and a horizontal wall separating the upper and lower sections, and wherein each section has a valve for independent inflation of the respective sections.

10. The catamaran boat of claim 1, wherein each inflatable pontoon has an upper surface, wherein a plurality of aligned eyelets is bonded to the upper surface of the pontoon, and wherein the respective longitudinal frame member is guided through the eyelets, thereby supporting the pontoon on the respective longitudinal frame member.

11. The catamaran boat of claim 1, further having a means for steering.

12. The catamaran boat of claim 11, wherein each longitudinal frame member has an aft end and the means for steering the boat is a pair of rudders releasably connected to the respective aft ends of the longitudinal frame members.

13. The catamaran boat of claim 12, further having a pair of tillers and a transverse member therebetween, wherein the rudders are releasably connected respectively to the tillers, and the transverse member is releasably connected to each tiller, whereby movement of the transverse member translates the respective movement to both rudders simultaneously.

14. The catamaran boat of claim 1, including a means for propulsion of the boat.

15. The catamaran boat of claim 14, wherein the means for propulsion comprises a sail.

16. The catamaran boat of claim 15, wherein the fore yoke member of the frame has an intermediate portion disposed between the longitudinal frame members, the intermediate portion being bent upwardly to form an arch, a mast releasably mounted on the arch, a boom releasably connected to the mast and a sail mounted between the mast and the boom and extending rearwardly therefrom.

17. The catamaran boat of claim 16, wherein each longitudinal frame member has an end extending forwardly and upwardly therefrom and a forward cross bar member extending transversely between the forwardly and upwardly extending ends of the longitudinal frame members, so that the forward cross bar member is substantially parallel to the fore yoke member and further is releasably connected to the respective forwardly and upwardly extending ends of the longitudinal frame members;

the catamaran boat further having a pair of stays connected to the forwardly and upwardly extending ends of the longitudinal frame members, the stays extending upwardly to a stay ring mounted on the mast;

such that the stays, the forwardly and upwardly extending ends of the longitudinal frame members and the cross bar member provide stability to the mast and sail.

18. The catamaran boat of claim 14, wherein the means for propulsion is a motor having a propeller.

19. The catamaran boat of claim 18, wherein the motor is mounted on the aft yoke member of the frame, the propeller extending downwardly.

20. The catamaran boat of claim 18, wherein the aft yoke member of the frame has an intermediate portion disposed between the longitudinal frame members, the intermediate portion being bent upwardly to form an arch, the motor releasably mounted on the arch, the propeller extending downwardly.

21. The catamaran boat of claim 20, wherein each longitudinal frame member has an aft end extending rearwardly of the aft yoke member and an aft cross bar member extending transversely to the aft end of each longitudinal frame member, the aft cross bar member being substantially parallel to the aft yoke member and further being releasably connected to the respective aft ends of each longitudinal frame member;

further having a rack connected between the aft cross bar member and the aft yoke member, the rack further having a well opening therein with a bottom and a least four side walls.

22. The catamaran boat of claim 21, wherein the motor is an electric motor having a battery for providing energy, further having the battery disposed in the well in the rack.

23. The catamaran boat of claim 21, wherein the well is a receptacle for food, drink and supplies.

24. The catamaran boat of claim 14, wherein the means of propulsion are oars.

25. The catamaran boat of claim 24, wherein each longitudinal frame has an oarlock mounted thereon and fitted thereto, a pair of oars.

26. In a catamaran boat, especially intended for knockdown disassembly and relatively rapid assembly, the combination which comprises: a generally rectangular frame including a pair of spaced-apart longitudinal frame members, the frame further including a pair of spaced-apart yoke members disposed substantially transversely of the longitudinal frame members and fore and aft of the boat, respectively, means for releasably connecting each yoke member to the longitudinal frame members, respectively, a pair of inflatable pontoons disposed below the longitudinal frame members, respectively, and having respective side portions, a top surface and a bottom surface, the pontoons further having an upper section, a lower section, and a horizontal wall separating the upper and lower sections, each section further having a valve for independent inflation of the respective sections;

the pontoons further having a pair of sleeves, fore and aft, extending laterally through the pontoon;

a pair of spaced-apart supporting pontoon locks for each pontoon, arranged fore and aft of the boat, respectively, wherein the pontoon lock is substantially "U" shaped and arranged transversely with respect to the pontoon, the pontoon lock including a pair of leg portions which are substantially parallel, an upper leg portion and a lower leg portion; the leg portions connected by an intermediate bight portion, the upper leg portion and the bight portion external to the pontoon, the lower leg portion passing transversely through the pontoon, and means for releasably connecting the pontoon lock to the yoke member such that a pair of supporting structural loops is provided for each pontoon and fore and aft thereof; and each pontoon further having a fin removably mounted on the bottom surface of the pontoon and each pontoon having a plurality of aligned eyelets on the top surface of the pontoon wherein the respective longitudinal frame member is guided through the eyelets thereby supporting the pontoon on the respective longitudinal frame member.

27. A catamaran boat, especially intended for knockdown disassembly and relatively rapid assembly, the combination which comprises: a generally rectangular frame including a pair of spaced-apart longitudinal frame members, the frame further including a pair of spaced-apart yoke members disposed substantially transversely of the longitudinal frame members and fore and aft of the boat, respectively, means for releasably connecting each yoke member to the longitudinal frame members, respectively, the fore yoke member having an intermediate portion disposed between the longitudinal frame members, the intermediate portion being bent upwardly to form an arch, a mast releasably mounted on the arch, a boom releasably connected to the mast, a sail mounted thereon for propulsion of the boat;

further, each longitudinal frame member having an end extending forwardly and upwardly therefrom and a forward cross bar member extending transversely between the forwardly and upwardly extending ends of the longitudinal frame members, so that the forward cross bar member is substantially parallel to the fore yoke member and further is releasably connected to the respective forwardly and upwardly extending ends of the longitudinal frame members, further having a pair of stays releasably connected to the forwardly and upwardly extending ends of the longitudinal frame members, the stays extending upwardly to a stay ring mounted on the mast; and a pair of inflatable pontoons disposed below the longitudinal frame members, respectively, and having respective side portions, a pair of spaced-apart supporting pontoon locks for each pontoon, arranged fore and aft of the boat, respectively, wherein the pontoon lock is substantially "U" shaped and arranged transversely with respect to the pontoon, the pontoon lock including a pair of leg portions which are substantially parallel, an upper leg portion and a lower leg portion; the leg portions connected by an intermediate bight portion, the upper leg portion and the bight portion external to the pontoon, the lower leg portion passing transversely through the pontoon, and means for releasably connecting the pontoon lock to the yoke member such that a pair of supporting structural loops is provided for each pontoon and fore and aft thereof.

28. In a catamaran boat, the combination which comprises a generally rectangular frame including a pair of spaced-apart longitudinal frame members, the frame further including a pair of spaced-apart yoke members disposed substantially transversely of the longitudinal frame members and fore and aft of the boat, respectively, means for connecting each yoke member to the longitudinal frame members, respectively, the fore yoke member having an intermediate portion disposed between the longitudinal frame members, the intermediate portion being bent upwardly to form an arch, a mast mounted on the arch, a boom connected to the mast, a sail mounted thereon for propulsion of the boat;

further, each longitudinal frame member having an end extending forwardly and upwardly therefrom and a forward cross bar member extending transversely between the forwardly and upwardly extending ends of the longitudinal frame members, so that the forward cross bar member is substantially parallel to the fore yoke member and further is releasably connected to the forwardly and upwardly extending ends of the longitudinal frame member;

further having a pair of stays connected to the forwardly and upwardly extending ends of the longitudinal frame members, the stays extending upwardly to a stay ring mounted on the mast;

a pair of pontoons disposed below the longitudinal frame members, respectively, and having respective side portions, a top surface and a bottom surface, the pontoons further having a pair of sleeves, fore and aft, extending laterally through the pontoon each pontoon; each pontoon further having a fin removably mounted on the bottom surface of the pontoon each pontoon having a plurality of aligned eyelets on the top surface of the pontoon wherein the respective longitudinal frame member is guided through the eyelet thereby supporting the pontoon on the respective longitudinal frame member;

a pair of spaced-apart supporting pontoon locks for each pontoon, arranged fore and aft of the boat, respectively, wherein the pontoon lock is substantially "U" shaped and arranged transversely with respect to the pontoon, the pontoon lock including a pair of leg portions which are substantially parallel, an upper leg portion and a lower leg portion; the leg portions connected by an intermediate bight portion, the upper leg portion and the bight portion external to the pontoon, the lower leg portion passing transversely through the pontoon, and means for releasably connecting the pontoon lock to the yoke member such that a pair of supporting structural loops is provided for each pontoon and fore and aft thereof.

29. The catamaran boat of claim 28 wherein the pontoons are inflatable, having an upper section and a lower section separated by a horizontal wall; each section further having a valve for independent inflation of the respective sections.

30. The catamaran boat of claim 28, wherein the boat is especially intended for knock-down disassembly and relatively rapid assembly, further having means for releasably connecting: the yoke members and the forward cross bar member to the longitudinal members, the mast to the fore yoke member, the boom to the mast, the pontoon lock to the fore and aft yoke members and the pontoons to the longitudinal members and the pontoon locks respectively.

31. In a catamaran boat especially intended for knock-down disassembly and relatively rapid assembly, wherein a pair of inflatable pontoons having respective side, top and bottom surfaces, are disposed below a generally rectangular frame having a pair of spaced-apart longitudinal members, the frame further have a pair of spaced-apart yoke members disposed substantially transversely of the longitudinal frame members and fore and aft of the boat, the improvements comprising: the pontoons having an upper section and lower section separated by a horizontal wall, each section further having a valve for independent inflation of the respective sections, the pontoons further having at least one sleeve, extending laterally through the pontoon, each pontoon further having a fin removably mounted on the bottom surface of the pontoon, each pontoon having a plurality of aligned eyelets on the top surface of the pontoon whereby the respective longitudinal frame member is guided through the eyelet thereby supporting the pontoon on the respective longitudinal frame member;

at least one pontoon lock for each pontoon, wherein the pontoon lock is substantially "U" shaped and arranged transversely with respect to the pontoon, the pontoon lock including a pair of leg portions which are substantially parallel, an upper leg portion and a lower leg portion; the leg portions connected by an intermediate bight portion, the upper leg portion and the bight portion external to the pontoon, the lower leg portion passing transversely through the pontoon, and means for releasably connecting the pontoon lock to the yoke member such that a supporting structural loop is provided for the pontoon;

the fore yoke member having an intermediate portion disposed between the longitudinal frame members, the intermediate portion being bent upwardly to form an arch, a mast releasably mounted on the arch, a boom releasably connected to the mast, a sail mounted thereon for propulsion of the boat;

and further, each longitudinal frame member having an end extending forwardly and upwardly therefrom and a forward cross bar member extending transversely between the forwardly and upwardly extending ends of the longitudinal frame members, so that the forward cross member is substantially parallel to the fore yoke member and further is releasable connected to the respective forwardly and upwardly extending ends of the longitudinal frame members, further having a pair of stays releasably connected to the forwardly and upwardly extending ends of the longitudinal frame members, the stays extending upwardly to a stay ring mounted on the mast.

32. The catamaran boat of claim 31, wherein the improvement further comprises pontoon locks connected fore and aft on each pontoon, releasably connected respectively to the fore yoke member and the aft yoke member.

33. In a catamaran boat, the combination which comprises a pair of longitudinal frame members each having a forward portion and a forward end, a pair of pontoons supported by the longitudinal frame members and disposed below the longitudinal frame members, each pontoon having a forward end, the forward ends of the pontoons extending forward of the forward ends of the longitudinal frame members;

a forward yoke member extending transversely of the longitudinal frame members;

means for releasably connecting the forward yoke member to the longitudinal frame members;

the forward yoke member having an intermediate portion disposed between the longitudinal frame members, the intermediate portion being bent upwardly from the pontoons to form arch;

a mast mounted on the arch of the intermediate portion of the forward yoke member, the mast having a stay ring connected thereto, the forward end portions of the longitudinal frame members extending upwardly, from the pontoons;

a cross bar frame member connected to the respective ends of the longitudinal frame members and extending transversely to the longitudinal frame members thereby forming a rectangle with the forward yoke member;

and a stay connected to the respective forward ends of each longitudinal frame member, the stays extending upwardly and connected to the stay ring mounted on the mast.

34. In a catamaran boat, especially intended for knockdown disassembly and relatively rapid assembly, the combination which comprises a generally rectangular frame including a pair of spaced-apart longitudinal frame members, the frame further including a pair of spaced-apart yoke members disposed substantially transversely of the longitudinal frame members and fore and aft of the boat, respectively, means for releasably connecting each yoke member to the longitudinal frame members, respectively, a pair of inflatable pontoons disposed below the longitudinal frame members, respectively, and having respective side portions, a top surface and a bottom surface, a pair of spaced-apart supporting pontoon locks for each pontoon, arranged fore and aft of the boat, respectively, wherein the pontoon lock is substantially "U" shaped and arranged transversely with respect to the pontoon, the pontoon lock including a pair of leg portions which are substantially parallel, an upper leg portion and a lower leg portion;

a removably mounted fin attached to the bottom surface of each pontoon, the pontoon having a pair of spaced apart clips, a first clip and a second clip, attached to the bottom surface of the pontoon, the first clip having at least one protrusion extending therefrom in the direction of the second clip, the second clip having a retractable latch extending therefrom in the direction of the first clip, the fin having a forward edge, an aft edge and a top edge, the aft edge of the fin , adjacent to the top edge having at least one opening therein wherein there may be inserted protrusion on the first clip, the forward edge of the fin adjacent to the top edge having an opening therein wherein there may be inserted the retractable latch extending from the second clip, whereby when the protrusion of the first clip is inserted into the opening on the aft edge of the fin, the top edge of fin is disposed adjacent to the bottom surface of the pontoon and the retractable latch on the second clip is inserted into the opening in the forward edge of the fin, the fin is securely and removably retained on the bottom surface of the pontoon.

35. A knock-down catamaran boat that is rugged and reliable and may be readily assembled and disassembled, comprising a plurality of molded-plastic tubular frame members adapted to be fitted together, and a pair of spaced-apart inflatable pontoons removably supported by the frame members and depending therefrom, such that the pontoons may be readily inflated during assembly of the boat and may be readily deflated during disassembly of the boat, wherein the frame members have respective portions nested within each other and frictionally held together, such that the frame members are removably secured together without the necessity for loose hardware, and wherein at least some of the respective nested portions of the frame members are keyed together to preclude relative rotation therebetween, wherein each pontoon has a substantially circular cross-section having a diametral axis, and wherein the frame members include respective pontoon locks arranged fore and aft on each pontoon, wherein each pontoon lock comprises a substantially "closed loop" pontoon-supporting structure which includes a portion thereof passing substantially horizontally through the pontoon and substantially adjacent to the diametral axis thereof.

36. A kit for a catamaran boat, especially intended for knock-down disassembly and relatively rapid assembly comprising: a generally rectangular frame including a pair of spaced-apart longitudinal frame members, each having a fore end, a mid portion and an aft end, the frame further including a pair of spaced-apart yoke members disposed substantially transversely of the longitudinal frame members and fore and aft of the boat, respectively, means for releasably connecting each yoke member to the longitudinal frame members respectively, a forward cross bar member and an aft cross bar member disposed transversely of the longitudinal frame members, means for releasably connecting each frame member to the longitudinal cross bar member;

a pair of inflatable pontoons disposed below the longitudinal frame members, respectively, and having respective side portions, a top surface and a bottom surface, each pontoon further having a pair of sleeves, fore and aft, extending laterally through the pontoons, each pontoon having a plurality of aligned eyelets on the top surface of the pontoon wherein the respective longitudinal frame member is guided through the eyelets thereby supporting the pontoon on the respective longitudinal frame member, a fin removably mounted on the bottom surface of the pontoon;

a pair of spaced-apart supporting pontoon locks for each pontoon arranged fore and aft, wherein the pontoon lock is substantially "U" shaped and arranged transversely with respect to the pontoon, the pontoon lock including a pair of leg portions which are substantially parallel, an upper leg portion and a lower leg portion; the leg portions connected by an intermediate bight portion, the upper leg portion and the bight portion external to the pontoon, the lower leg portion passing transversely through the pontoon, and means for releasably connecting the pontoon lock to the yoke member such that a pair of supporting structural loops is provided for each pontoon and fore and aft thereof;

a mast releasably connected to the fore yoke member, a boom releasably connected to the mast, a sail mounted on the boom and mast, a stay ring mounted on the mast and a plurality of stays connecting the stay ring to the fore ends of the longitudinal frame members and to the mid portion of the longitudinal frame members to support the mast and sail;

a rudder releasably connected respectively to the aft end of each longitudinal frame member, a tiller releasably connected to each respective rudder, a transverse member releasably connected to the tillers;

a rack releasably connected between the aft yoke member and the aft cross bar member, the rack further having a well therein;

a deck releasably connected to the rectangular frame members; and hardware and fitting thereto.

37. The kit for a catamaran boat of claim 36, further comprising a motor and a motor mount releasably connected to the aft yoke member.

38. The kit for a catamaran boat of claim 36 further comprising a pair of oars and a pair of oarlocks, the oarlocks releasably connected respectively to the pair of longitudinal frame members.

39. A method for assembling a catamaran boat comprising the steps of:

providing a pair of longitudinal frame members, each having fore ends, aft ends and mid portions;

placing the pair of longitudinal frame members substantially parallel to each other;

providing a pair of inflatable pontoons, each pontoon having side portions, an upper section, a lower section, a horizontal wall separating the upper and lower sections, a valve for independent inflation of each section, a pair of sleeves extending laterally through the pontoon, a lower surface and an upper surface, wherein a plurality of aligned eyelets are bonded to the upper surface;

providing a deck having front edges, back edges, and side edges, wherein a plurality of loops are attached to the front and back edges and the side edges have a sleeve therein;

aligning the eyelets on the top of the pontoon with the sides of the deck;

guiding the longitudinal frame members through the eyelets on the pontoons and the sides of the deck, so that each pontoon is disposed below the longitudinal frame member;

providing a pair of yoke members having an intermediate portion, the intermediate portion being bent upwardly to form an arch;

inserting the yoke members through the loops on the fore and aft edges of the deck;

releasably connecting the longitudinal frame members to the yoke members to form a generally rectangular frame;

providing a forward cross bar member and an aft cross bar member;

releasably connecting the fore ends of each longitudinal frame member to the forward cross bar member therebetween;

releasably connecting the aft ends of each longitudinal frame member to the aft cross bar member therebetween;

providing a pontoon lock, including an upper leg portion, a lower leg portion and a bight portion;

releasably connecting the bight portion of the pontoon lock to the upper leg portion and to the lower leg portion to form a "U" shaped pontoon lock, the leg portions being substantially parallel and assembling a pair of pontoon locks for each pontoon;

inflating the upper section and the lower section of the pontoon;

inserting the lower leg of the pontoon lock through the sleeve in the pontoon so that the upper leg portion and bight portion are disposed external to and above the pontoon, fore and aft on each pontoon;

releasably connecting the upper leg and the lower leg of the pontoon lock to the fore yoke member and the aft yoke member such that a pair of supporting structural loops is provided for each pontoon and fore and aft thereof;

providing a pair of rudders, a pair of tillers and a transverse member;

releasably connecting the aft ends of each longitudinal frame member to a rudder;

releasably connecting each rudder to a tiller disposed above the rectangular frame;

releasably connecting each tiller with a transverse member therebetween so that movement of the transverse member translates the respective movement to both rudders simultaneously;

providing a rack having a well opening herein;

releasably connecting the rack to the aft transverse member and to the arched portion of the aft yoke member;

providing a pair of fins;

removably connecting the fin to the lower surface of each pontoon;

providing a first pair and a second pair of stays, each stay further having a first end and a second end;

providing a stay ring;

releasably connecting the first ends of the first pair of stays to the forward ends of each longitudinal frame member;

releasably connecting the second ends of the first pair of stays to a stay ring;

releasably connecting the first ends of a second pair of stays to the stay ring;

releasably connecting the second ends of the second pair of stays to the midportion of each longitudinal frame;

providing a mast with a first and a second end a boom and a sail;

releasably connecting the stay ring near first end of the mast;

releasably connecting the boom to the mast;

releasably connecting the sail to the mast and boom;

inserting the second end of the mast in the mount on the arched portion of the fore yoke member such that the mast projects upwardly from the yoke member and is held stably in place by the stays.

* * * * *